US006378828B1

(12) United States Patent
Valiulis et al.

(10) Patent No.: US 6,378,828 B1
(45) Date of Patent: Apr. 30, 2002

(54) CROSSBAR BRACKET

(75) Inventors: Stanley C. Valiulis, Rockford; Craig Zadak, Roscoe, both of IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 09/570,662

(22) Filed: May 15, 2000

(51) Int. Cl.[7] ..... A47B 96/06

(52) U.S. Cl. ..... 248/231.81; 248/220.22; 248/304; 211/59.1

(58) Field of Search ..... 248/231.81, 304, 248/301, 220.22, 220.31; 211/59.1, 54.1, 94.9, 57.1

(56) References Cited

U.S. PATENT DOCUMENTS 2,665,869 A * 1/1954 Samuels ..... 248/214
3,989,213 A * 11/1976 Allen ..... 248/214
4,405,051 A * 9/1983 Thalenfeld ..... 211/57.1
4,593,824 A * 6/1986 Pfeifer ..... 211/57.1
4,671,002 A * 6/1987 Fast ..... 40/655
4,671,417 A * 6/1987 O'Brien ..... 211/59.1
4,773,172 A * 9/1988 Fast ..... 40/657
5,400,992 A * 3/1995 Pohl ..... 248/231.81
5,582,376 A 12/1996 Thompson ..... 248/214
5,588,166 A * 12/1996 Burnett ..... 5/503.1
5,871,115 A * 2/1999 Kohn ..... 220/485
5,901,860 A * 5/1999 Nowicki ..... 211/59.1
6,024,230 A * 2/2000 Menaged et al. ..... 211/87.01
6,029,827 A * 2/2000 Valiulis ..... 211/59.1
6,119,874 A * 9/2000 Anderson ..... 211/57.1

OTHER PUBLICATIONS

Pp. 41–42, 1999 Catalog Southern Imperial, Inc.

* cited by examiner

*Primary Examiner*—Ramon O. Ramirez
*Assistant Examiner*—Holly N. Sy
(74) *Attorney, Agent, or Firm*—Leydig, Voit & Mayer, LTD

(57) ABSTRACT

A display apparatus mounting bracket, adapted for attachment to a crossbar, is provided generally having a U-shaped bracket having a front plate and a flange, the front plate adapted to mount display apparatus thereto, the flange having a top portion projecting away from the front plate and a rear portion disposed generally parallel to the face. The inner surfaces of the front plate and flange define an interior space for receiving the crossbar, and the downward ends of the front plate and rear portion of the flange define an entrance to the interior space. The structure of the rear portion of the flange provides a high load-bearing capacity of the mounting bracket. The entrance of the bracket provides a snap-fit with the crossbar providing a snug fitting interior space for receiving the crossbar, thereby safely and securely retaining the crossbar within the interior space when snapped into place.

21 Claims, 3 Drawing Sheets

CROSSBAR BRACKET

FIELD OF THE INVENTION

The present invention relates generally to merchandise display apparatus, and more particularly relates to mounting devices for merchandise display apparatus.

BACKGROUND OF THE INVENTION

In the retail industry, mounting devices are commonly used to suspend display apparatuses such as wire hooks, baskets or shelves from a vertical support. Common supports include pegboards, slot walls, wire grids and crossbars. The display apparatuses are used to display merchandise products for sale. Since retail stores frequently offer new products for sale, they are often required to move and re-arrange the merchandise products accordingly. Therefore, the display apparatuses, mounting devices, and associated supports are generally constructed to accommodate the ever-changing display of merchandise, i.e. facilitating re-arrangement.

With regard to crossbars, brackets are often used to mount a display apparatus to the crossbar, thereby vertically mounting the apparatus and its merchandise products for display. A typical crossbar bracket generally comprises a front plate and two rearwardly projecting tabs as shown on pages 41–42 of the 1999 Southern Imperial Catalog. The tabs extend from the upper end of the front plate and are bent relative thereto to form a small hook. Typically the tabs are rolled to form curved hooks. The hooked tabs are used to attach the device to a crossbar, and are placed over the upper surface of the crossbar to engage the uppermost portion of the crossbar, while the front plate is disposed adjacent the forward facing surface of the crossbar. A lower end of the tabs may engage the rearward facing surface of the crossbar. Thus, these brackets provide simple and quick attachment of a display device to a cross bar, and can be easily removed and repositioned along the same crossbar or a different one during re-arrangement of a retail store.

Although these crossbar brackets have enjoyed much commercial success and have the benefit of easy installation, removal and re-installation, experience has shown that the load-bearing capacity of these brackets is often insufficient. While the prior art brackets are satisfactory for smaller and hence lighter merchandise items, these brackets may be prone to failure when heavier items induce increased loads on the bracket. Specifically, the rear tabs of the brackets which provide the easy installation are unable to sustain high loads, and will bend under the stress placed thereon. Furthermore, these brackets suffer in that they may be accidentally removed from the crossbar when patrons remove merchandise products from the display apparatus which is attached to the bracket.

SUMMARY OF THE INVENTION

In light of the above, a general object of the present invention is to provide a crossbar bracket having a higher load-bearing capacity suitable for the retail industry.

In that regard, it is also an object of the present invention to accomplish the above objective while maintaining the ease and simplicity of attachment and removal of the crossbar bracket.

It is a further object of the present invention to provide a crossbar bracket that remains attached to the crossbar as products are removed from the display apparatus attached to the bracket.

In accordance with these objects, the present invention provides a display apparatus mountingbracket that snaps onto a crossbar and that has longer rear mounting legs that provide greater load bearing capacity. The mounting bracket is generally U-shaped as defined by a substantially parallel front plate and flange. The front plate is adapted to have display apparatus mounted thereto. The flange includes a top portion or top and a rear portion or leg, the top portion attached to the front plate and projecting away therefrom, the rear portion disposed generally parallel to the front plate. The inner surfaces of the front plate and flange define an interior space for receiving the crossbar, and between the lower ends of the front plate and rear portion of the flange is defined an entrance to the interior space. The rear flange projects downwardly a distance approximately half the height of the crossbar to which the bracket is to be attached. The parallel nature of the rear flange relative to the crossbar, and the distance which it extends downward along the crossbar, provides the high load-bearing capacity of the mounting bracket. In contrast to prior art devices, the rear portion or leg of the flange is longer which requires more bending and therefore a greater vertical force to dislodge the bracket from the crossbar.

It is a feature of the present invention to orient the entrance of the bracket such that the bracket provides a snap-fit with the crossbar. The benefits of such a construction are two-fold. First, the snap-fit construction maintains the simplicity with which the mounting device may be attached and removed from a crossbar. Second, the snap-fit construction provides a snug fitting interior space for receiving the crossbar, thereby safely and securely retaining the crossbar within the interior space when snapped into place to prevent the bracket from being accidentally removed from the crossbar by patrons retrieving merchandise.

In that regard, it is a further feature of the present invention to angle the downward end of the front plate towards the rear portion of the flange. This decreases the size of the entrance and orients the entrance such that the crossbar does not naturally fit through the entrance. The bracket is constructed of a resilient material, such that the front plate and flange may flex outwardly from the interior space, thereby widening the entrance and allowing the crossbar to enter the interior space. Upon receiving the crossbar, the resilient front plate and flange return to their original positions, securing the crossbar within the interior space. The quick flexing and return of the bracket produces a snap-fit with the crossbar.

These and other object and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
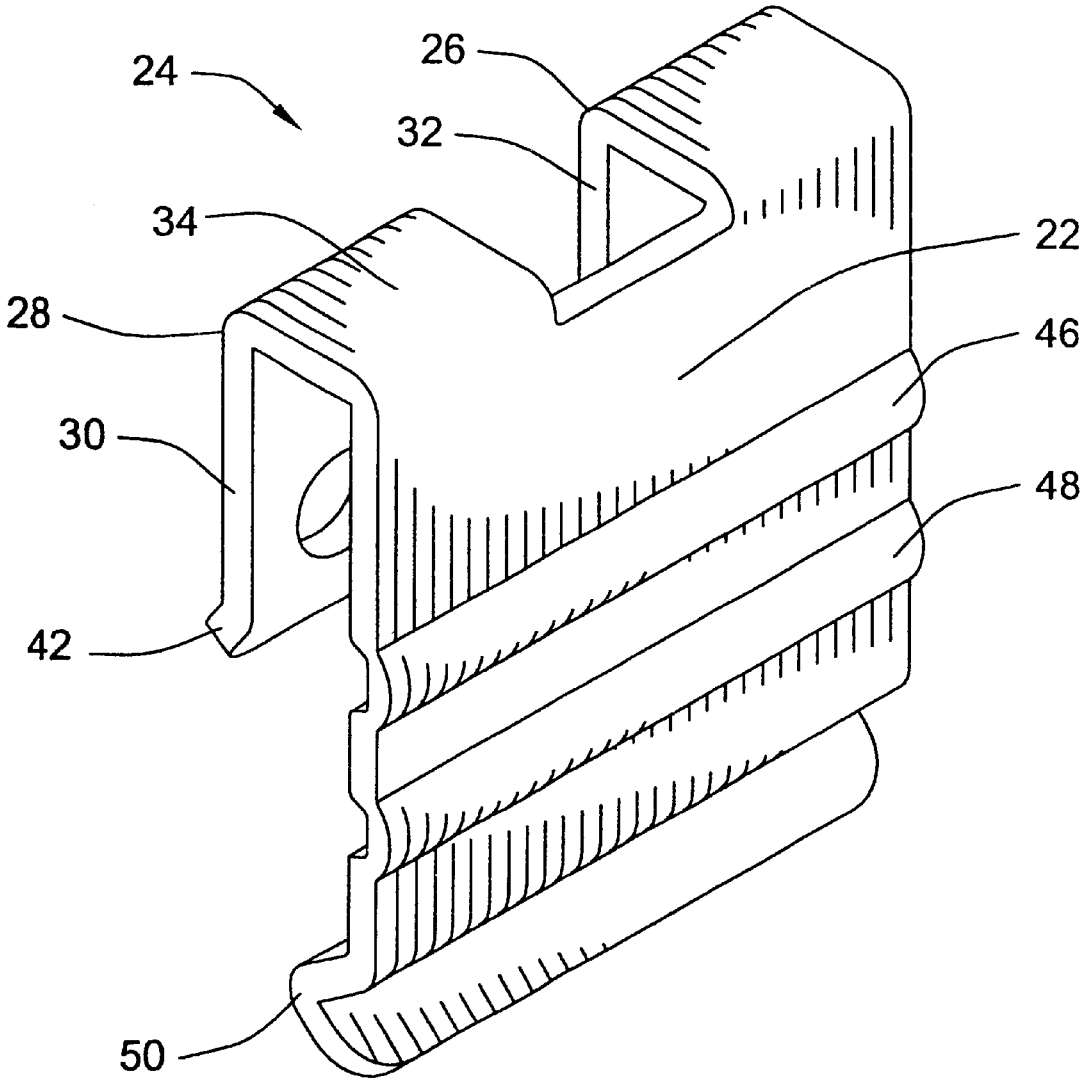
FIG. 1 is a perspective view of the preferred embodiment of the mounting device.
Figure 2:
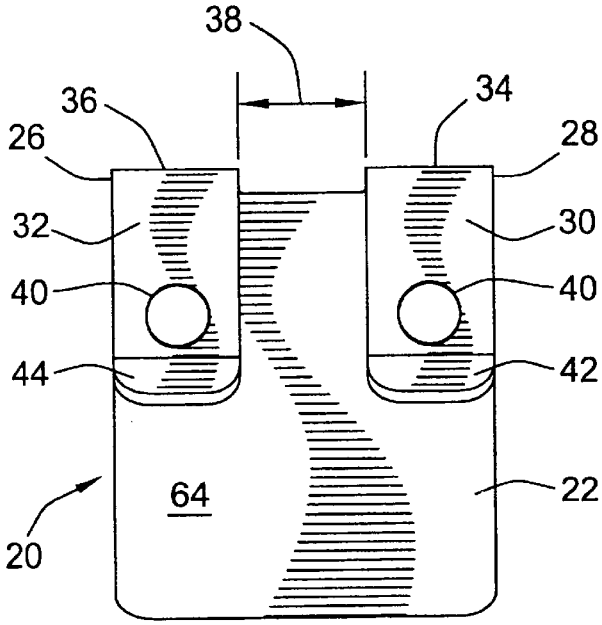
FIG. 2 is a rear view of the mounting device of FIG. 1.
Figure 3:
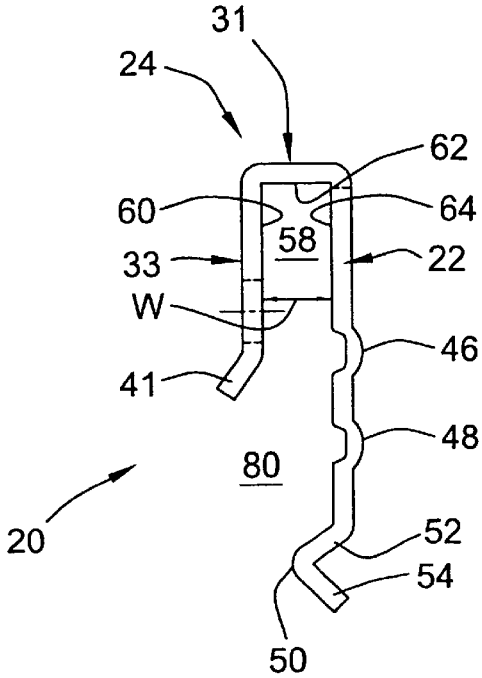
FIG. 3 is a side view of the mounting device of FIG. 1.

Referring now to the drawings, FIGS. 1, 2 and 3 show a preferred embodiment of the present invention in the form of a crossbar mounting bracket 20 which may be stamped and formed from sheet metal material. The crossbar bracket 20 is generally U-shaped and comprises a front plate 22 and a flange 24 extending away from and disposed generally parallel to the front plate 22. The front plate 22 is adapted to mount a display apparatus (see FIG. 6) to the forward facing surface of the front plate 22. The flange 24, in conjunction with the front plate 22, clips to a crossbar of a vertical support commonly used in the retail industry. By way of the inventive features of the present invention, it will be readily understood by one of ordinary skill in the art that through the use of the crossbar bracket 20, merchandise products, even those inducing high loads on the bracket, may be displayed, while the ease and simplicity of mounting the display apparatus is maintained. The bracket also protects against inadvertent removal from the crossbar by patrons.

It should be noted that the terms vertical and horizontal as used throughout refer generally to how crossbars are normally mounted and oriented such that the top portion 31 normally rests on the top surface of the crossbar. The terms vertical and horizontal thus refer to a typical orientation of a crossbar and therefore include situations where the crossbar is disposed diagonal by virtue of a different mounting or because the display is tilted.

Various display apparatus may be employed in conjunction with the present invention, including wire hooks, baskets and shelves. The mounting of a display apparatus is accomplished in the preferred embodiment by providing a front plate 22 that includes a first horizontally projecting boss 46 and a second horizontally projecting boss 48, as best seen in FIGS. 1 and 3. The first and second bosses 46, 48 are raised from the outer surface of the front plate 22 and provide a small area for welding the display apparatus (not shown) to the front plate 22, and more particularly to the bosses 46, 48. In the preferred embodiment shown, bosses 46, 48 are formed by stamping the front plate 22, leaving indentations in the inner surface 64 of the front plate 22, although the bosses 46, 48 may be formed by other conventional means. The utilization of the first and second bosses 46, 48 reduces the amount of solder required to securely attach the display apparatus to the face. As will be appreciated by those of ordinary skill in the art, display apparatus may be welded to the front plate without bosses 46, 48, and may also be attached via other conventional means such as by providing apertures, slots, channels or other mounting structures known in the art.

The flange 24 of the crossbar bracket 20 generally comprises a horizontally extending top portion 31 and a vertically downwardly depending rear portion 33. In the preferred embodiment, a slot 38 has been provided in the flange 24, best seen in FIG. 2. The slot 38 separates the flange 24 into a first leg 26 and a second leg 28. The flange 24 may comprise a singular solid piece without departing from the scope of the invention, although in the preferred embodiment the flange 24 includes slot 38 between legs 26 28. The slot 38 can be used to receive a vertically oriented support beam connected to a rear surface of a crossbar, thereby permitting attachment of the bracket 20 in places where the rear surface of the crossbar is not completely free or clear. Further, slot 38 reduces the area and physical structure of flange 24, thereby increasing the flexibility of the first and second legs 26, 28, the effect of which will be discussed herein.

As illustrated in FIG. 2, the first and second legs 26, 28 each include a vertically disposed rear portion 30, 32 and a horizontally disposed top portion 34, 36, respectively. The top portions 34, 36 integrally connect the rear portions 30, 32 to the front plate 22 of the bracket 20. Each of the rear portions 30, 32 of the legs 26, 28 preferably include an aperture 40 that allows the crossbar bracket 20 to be mounted for finishing techniques during manufacture such as metal plating, if so desired.

Turning to FIG. 3, the top portion 31 of the flange 24 is attached to and projects away from the front plate 22, and connects the rear portion 33 and front plate 22. The top portion 31 is attached proximate an upper end of the front plate 22. The rear portion 33 extends downwardly from the top portion 31 and is disposed generally parallel to the front plate 22. In the preferred embodiment, the top portion 31 is disposed generally perpendicular to the front plate 22, and hence the rear portion 33 as well. The top portion 31 spaces the rear portion 33 of the flange 24 a predetermined distance away from the front plate 22 for receiving a crossbar therebetween.

Figure 4:
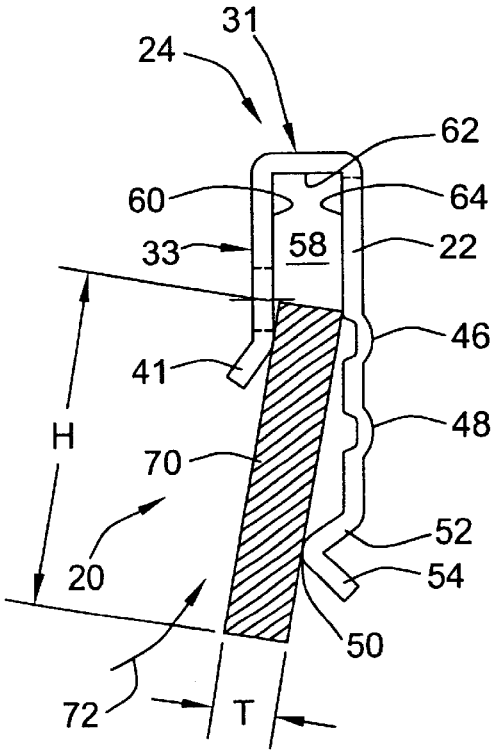
FIG. 4 is a side view of the mounting device of FIG. 1 as it is being mounted to a crossbar.

As best seen in FIGS. 3 and 4, the inner surface 64 of the front plate 22 and the inner surfaces 60, 62 of the flange 24 define an interior space 58 for receiving a crossbar. The inner space 58 has a width W defined by the distance between the inner surface 60 of the flange's rear portion 33 and the inner surface 64 of the face 22. This width W is sized to closely fit with the thickness T of a crossbar to which the bracket 20 is to be attached, albeit slightly larger. Similarly, the front plate 22, excluding bent lower end 50, extends downwardly from the top portion of the flange 24 a distance slightly larger than the height H of the crossbar 70, best seen in FIGS. 4 and 5. It will be understood by those skilled in the art that retail crossbars are produced in standard cross-sectional sizes, such as 3⁄16"×1". Nonetheless, crossbars of varying dimensions may also be used, and therefore the crossbar bracket of the present invention may be dimensioned to comply with various crossbar sizes. Conventional crossbars in the industry may for example have widths between about 0.125 and 1.25 inches, and vertical heights between about 0.5 and 1.5 inches. For example, some common crossbar sizes are 3⁄16"×1", ¼"×1", 1"×1", and ½"×1". In the preferred embodiment, the crossbar bracket 20 has an interior space having a width W equal to approximately 0.205" while the height of the front plate 22, excluding its bent lower end 50, is approximately 1.010", both sized for use with a standard crossbar having a 3⁄16"×1" cross-section.

A study of FIGS. 2 and 3 reveals that the front plate 22 includes a bent lower locking end 50 for inhibiting vertical removal of the bracket 20. Likewise, the rear portions 30, 32 of the legs 26, 28 include lower ends 42, 44, i.e. the rear portion 33 of the flange 24 includes a lower end 41. The space between the lower end 41 of the rear portion 33 and the lower end 50 of the front plate 22 defines an entrance 80 to the interior space 58. Therefore, for a crossbar to be received within interior space 58, it first must pass through entrance 80. In the preferred embodiment, the lower end 41 of the flange 24 is angled outwardly away from the entrance 80 and front plate 22. The lower end 41 aids in directing a crossbar through the entrance 80 and into the interior space 58, as best seen in FIG. 4. In the preferred embodiment shown, the lower end 41 of the flange 24, i.e. the lower ends 42, 44 of the legs 26, 28, are angled approximately 1450 relative to the rear portions 30, 32.

It is a feature of the present invention to size and orient the entrance 80 of the bracket 20 such that the bracket 20 provides a snap-fit with the crossbar 70. In the preferred embodiment, this is accomplished in part by angling the lower locking end 50 of the front plate 22 such that it extends horizontally toward the flange 24. The locking end 50 decreases the size of the entrance 80 and orients the entrance 80 such that a crossbar 70 does not naturally fit through the entrance 80 to be received within the interior space 58 of the bracket 20. As shown in FIG. 4, the entrance 80 is diagonal between locking end 50 and lower end 41. It will be understood that the vertical length of the rear portion 33 of the flange 24, also determines the size and orientation of the entrance 80 and is equally important in constructing a crossbar bracket according to the present invention, and is discussed in more detail below.

In the preferred embodiment, the lower locking end 50 of the front plate 22 includes a inwardly angled section 52 and an outwardly angled section 54, the outwardly angled section 54 representing the most downward portion of the front plate 22. The inwardly angled section 52 projects towards the rear portion 33 of the flange 24, while the outwardly angled section 54 is projects away from the rear portion 33 of the flange 24.

Figure 5:
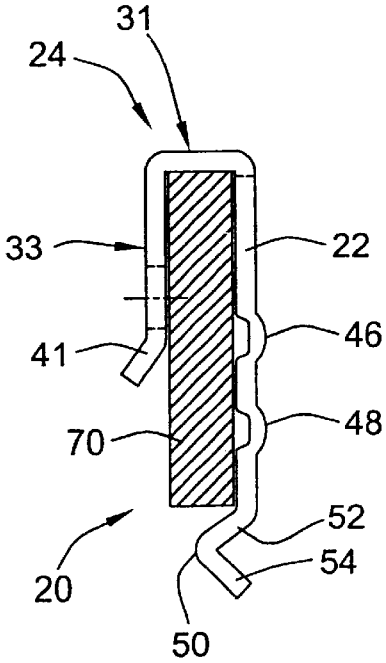
FIG. 5 is a side view of the mounting device of FIG. 1 mounted to a crossbar.

FIG. 4 illustrates the bracket 20 being placed on a crossbar 70, indicated by arrow 72. Crossbar 70 extends through the entrance 80, into the interior space 58, wherein it can clearly be seen that the natural disposition of the entrance 80 prevents the crossbar 70 from fully entering the interior space 58. However, in order to provide a snap-fit, the bracket 20 is constructed of a resilient material having inherent flexibility. In the preferred embodiment the bracket 20 is constructed from 1008 sheet steel, 16 gauge. Nonetheless, a resilient plastic may also be used to construct the bracket 20 in accordance with the present invention. During crossbar insertion, the front plate 22 and/or flange 24 deflect outwardly, away from each other, thereby widening the entrance 80 a sufficient amount to allow the crossbar 70 to enter the interior space 58. As shown in FIG. 5, interior space 58 ultimately receives the crossbar 70. Upon receiving the crossbar 70, the resilient front plate 22 and/or flange 24 return to their original positions, securing the crossbar 70 within the interior space. Slot 38 may be provided in the flange 24 to increase the adaptability of the bracket 20 and to provide a sufficient amount of flexibility and resiliency of the flange portion 24. The quick flexing and return of the bracket portions produces a snap-fit with the crossbar 70.

As previously noted, the flange's rear portion 33 and the locking end 50, are disposed to size and orient the entrance 80 such that it prevents the natural entry of the crossbar 70 into the interior space 58. The specific angle and length of the first end portion 52 required to dispose the entrance 80 as required, is dependent upon the size of the crossbar, and hence the interior space, as well as the vertical distance between the downward ends of the front plate 22 and flange 24. As previously discussed, the interior space 58 has a width W slightly larger than the thickness T of the crossbar 70. Further, the front plate 22, excluding the lower locking end 50, extends downward from the top portion of the flange 24 a distance slightly larger than the height H of the crossbar 70. Thus the interior space 58 is closely fitted to the crossbar 70. The majority of the inner surfaces of the bracket 20, i.e. inner surface 64 of the front plate 22 and inner surfaces 60 and 62 of the flange 24, are flush with the crossbar 70, as best seen in FIG. 5. By doing so, and in combination with the snap-fit discussed above, the bracket 20 is securely attached to the crossbar and prevents the inadvertent removal of the bracket by patrons removing products from the display apparatus attached to the front plate 22. When products are retrieved, an upward force is transmitted to the front plate 22 of the bracket 20. This upward force is countered by the bent lower locking end 50 and flange 24, by virtue of their structure and the close fitting design of the bracket 20. The locking end 50 prevents the bracket 20 from being lifted off the crossbar 70 with upward vertical forces. It can be seen that lower end 50 does not touch the rear or bottom surface of the crossbar 70 when resting on the crossbar 70, although the lower end 50 will engage the lower front comer of the crossbar 70 when an upward force is placed on the bracket 20 as products are removed from the attached display apparatus (see FIG. 6).

It is another feature of the present invention to provide a flange 24 having a long vertical rear portion 33, in which the rear portions 30, 32 of the legs 26, 28 project downwardly, parallel to the face, a distance approximately half the height H of the crossbar 70 to which the bracket 20 is to be attached, or even longer. Because the lower ends 42, 44 are angled outwardly, the aforementioned distance that the rear portions 30, 32 project excludes the angled ends 42, 44 which act as guides to ease insertion of a crossbar through the entrance 80. The parallel nature of the rear flange relative to the crossbar, and the distance which it extends downward along the crossbar, provides a high load-bearing capacity of the mounting device. The entire vertical length of the rear portion 33, excluding lower end 41, is flush with the crossbar 70 in the loaded position. When a display apparatus (not shown) is attached to the front plate 22, the weight of merchandise creates a downward force that is transmitted to the bracket 20. Referring to FIG. 5, the bracket 20 will attempt to rotate clockwise relative to the crossbar 70. Hence a large portion of the force created by the merchandise weight is transmitted to the rear portion 31 of the flange 24, which is relied upon to maintain the engagement of the crossbar 70 and the bracket 20. It will be understood by those have skill in the art that the longer the rear portion 33 (i.e. the portion of the flange flush with a rear surface of the crossbar) the more the rear portion 33 must flex or bend outwardly away from the front plate 22 to disengage the crossbar 70. With the present invention, the rear portion 33 must bend or flex a greater distance outward for the bracket 20 to unmount from the crossbar 70. Because more force is required to facilitate this bending, the bracket 20 has a higher load-bearing capacity. Similarly, when the rear portion 33 is parallel to the front plate 22 and flush with the crossbar 70, the more the rear portion 33 must flex or bend outwardly to disengage the crossbar 70 when compared to a rear portion that is already angled outwardly and is naturally disposed in a position not parallel to the front plate 22. By providing a rear portion 33 of the flange 24 that extends downwardly a longer distance, such as about one half the height H of the crossbar or more, the bracket 20 has a larger load-bearing capacity that is suitable for the retail industry. At the same time, the entrance 80 is oriented to provide a snap-fit by virtue of lower locking end 50, and the bracket 20 may be easily and securely attached to a crossbar 70.

Accordingly, the preferred embodiment of the present invention, as shown in FIGS. 4 and 5, includes rear portions 30, 32 of the legs 26, 28 which extend downward from the top portions 34, 36 approximately half the height of the crossbar 70, for high load-bearing capacity. First end portion 52 of the front plate's lower end 50 is angled approximately 125° relative to the front plate 22 and extends inward a lateral distance that is at least half the width W of the interior space 58, and thus more than half the thickness T of the crossbar 70 as well. The second end portion 54 of lower end 50 is angled back away from the interior space 58, and in the preferred embodiment is disposed approximately 80° relative to first end portion 52.

Figure 6:
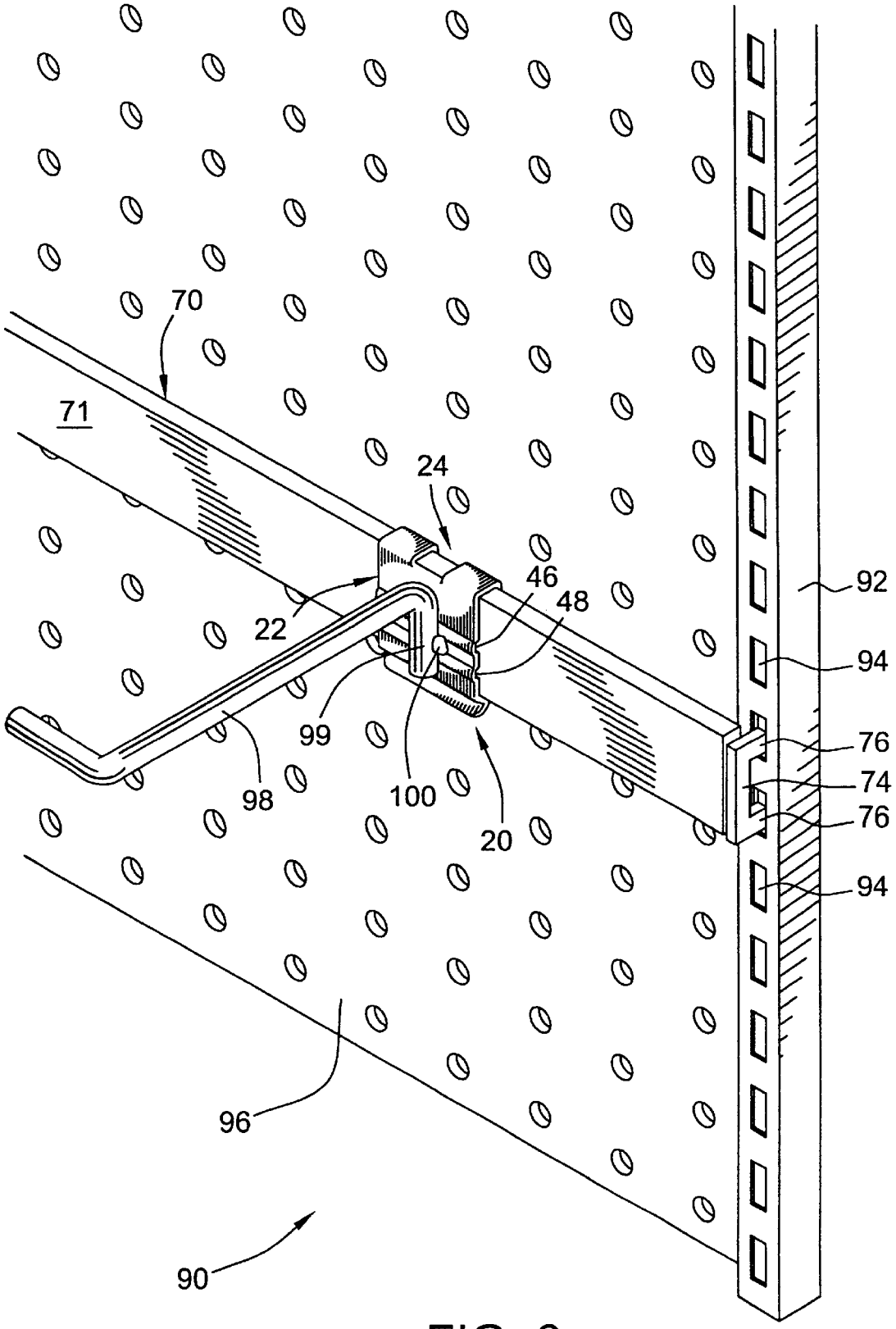
FIG. 6 is a perspective view of the mounting device of FIG. 1 mounted to a crossbar and having a display apparatus attached thereto.

Referring now to FIG. 6, the preferred embodiment of the mounting bracket 20 is shown attached to a crossbar 70, and has a display apparatus 98 attached thereto. FIG. 6 illustrates a common retail display unit 90, comprising a slotted vertical support 92 and a vertical pegboard wall 96 connected to the vertical support 92. A crossbar 70 is attached to the vertical support 92 by way of mount 74 and extends horizontally. Mount 74 is mechanically linked to an end of the crossbar 70 and attaches to the vertical support 92 via slots 94 provided in the vertical support 92. Mount 74 includes hooked tabs 76 which extend through slots 94 and engage the vertical support 92. It will be understood that mount 74 may be integrally formed with the crossbar 70, or that crossbar 70 may be adapted to mount to various other display units such as wire grids, racks, stands or shelves, without departing from the scope of the present invention. The mounting bracket 20 is shown attached to the crossbar 70, the front plate 22 being flush with a forward facing surface 71 of the crossbar 70. As previously discussed, the front plate 22 includes bosses 46, 48 on its outer surface for mounting a display apparatus 98 thereto. The display apparatus shown in FIG. 6 is a wire hook 98 having a bent attachment end 99. The bent end 99 of wire hook 98 is welded to the front plate 22 across the bosses 46, 48 by solder 100.

From the foregoing description one of ordinary skill in the art can readily see that the mounting bracket 20 of the present invention provides a crossbar bracket having a high load-bearing capacity suitable for the retail industry, yet maintains the ease and simplicity of attachment and removal of the crossbar bracket. The snap-fit construction of the present invention provides a snug fitting interior space for receiving the crossbar, thereby safely and securely retaining the crossbar within the interior space when snapped into place and preventing the inadvertent removal of the bracket from the crossbar by patrons retrieving merchandise. The mounting bracket provides retailers with the ability to mount heavier merchandise products to a retail display.

What is claimed is:

1. A generally U-shaped flexible mounting bracket for attachment to a rectangular crossbar mounted horizontally on a merchandising unit, comprising:

a front plate extending in a vertical plane a distance closely corresponding to the vertical height of the crossbar, adapted to have display apparatus mounted thereto;

a flange integrally joined to the front plate and extending rearwardly therefrom, the flange including a horizontally extending top and a vertically downward depending leg, the leg being selectively spaced from the front plate at a width closely sized to the horizontal thickness of the crossbar for receiving the crossbar therebetween;

a locking structure formed into the front plate at a vertical distance from the top greater than the vertical height of the crossbar, the locking structure projecting horizontally towards the leg but terminating horizontally short of the leg to provide a horizontal distance between the leg and the locking structure that is less than the horizontal thickness of the crossbar; and the locking structure of the front plate being positioned sufficiently from the top such that the locking structure does not engage the crossbar when the mounting bracket is attached to and resting on the crossbar, and wherein upward movement of the mounting bracket relative to the crossbar causes the locking structure to engage a front lower corner of the crossbar.

2. The mounting bracket of claim 1 further comprising a diagonal entrance for insertion of the crossbar therethrough, defined between the locking structure and a downward end of the leg by virtue of the leg being positioned vertically above the locking structure.

3. A mounting bracket as in claim 2, wherein the mounting bracket is constructed of resilient material, the front plate and the leg adapted to flex away from each other to widen the entrance sufficiently to permit the crossbar to enter into the mounting bracket with clearance past the locking structure.

4. A mounting bracket as in claim 1, wherein the leg extends vertically downward from the top portion along a crossbar engaging surface a distance at least approximately one half of the vertical thickness of the crossbar.

5. A mounting bracket as in claim 1 wherein the flange includes two of said legs separated by a slot, and wherein each leg includes an outwardly angled guide surface at a lower end adapted for guiding the crossbar into an entrance defined between the lower ends of the legs and the locking structure.

6. The mounting bracket as in claim 1 wherein the front plate, the top and the leg are all generally planar, the front plate being parallel with the leg, the top being perpendicular to the leg and the front plate, whereby the front plate, the leg and the top are adapted to lie substantially flush with the crossbar.

7. The mounting bracket as in claim 1 wherein the mounting bracket is formed from sheet metal of a constant thickness, the locking structure being formed by a horizontally inward bend in the sheet metal to provide a first section angling horizontally toward the leg and downwardly, and wherein the locking structure includes an outward bend in the sheet metal located below the inward bend to provide a second section angling horizontally away from the leg and downwardly.

8. A mounting bracket as in claim 1, wherein the mounting bracket is formed of unitary metal.

9. A unitary, generally U-shaped, flexible metal mounting bracket for attachment to a rectangular crossbar mounted horizontally on a merchandising unit, comprising:

a front plate extending in a vertical plane a distance closely corresponding to the vertical thickness of the crossbar, adapted to have display apparatus mounted thereto;

a flange integrally joined to the front plate and extending rearward therefrom, the flange including a horizontally extending top and a vertically downward depending leg, the leg being selectively spaced from the front plate at a width closely sized to the horizontal thickness of the crossbar for receiving the crossbar therebetween in an interior space;

a locking structure formed into the front plate, the locking structure projecting horizontally towards the leg but terminating horizontally short of the leg to provide a horizontal distance between the leg and the locking structure that is less than the horizontal thickness of the crossbar, the locking structure being forged by a horizontally inward bend in the front plate to provide a first section angling horizontally toward the leg and downwardly, and wherein the locking structure includes an outward bend in the front plate located below the inward bend to provide a second section angling horizontally away from the leg and downwardly; and the leg extending downwardly a distance at least approximately one half of the vertical thickness of the crossbar.

10. A mounting bracket as in claim 9 wherein the front plate, the top and the leg are all generally planar, the front plate being parallel with the leg, the top being perpendicular to the leg and the front plate, whereby the front plate, the leg and the top are adapted to lie substantially flush with the crossbar.

11. A mounting bracket as in claim 9, wherein the flange includes two of said legs separated by a slot, and wherein each leg includes an outwardly angled guide surface at a lower end of the leg.

12. A mounting bracket as in claim 9, wherein a lower end of the front plate is angled to project laterally from the front plate, the lower end of the front plate and a lower end of the leg defining an entrance to the interior space that is sized and oriented, in the entrance's natural state, to prevent the crossbar from entering the interior space.

13. A mounting bracket as in claim 12, wherein the entrance enlarges to allow the crossbar to pass therethrough and be received within the interior space.

14. A mounting bracket as in claim 9, wherein the front plate, excluding the locking structure, has a height greater than or equal to the vertical thickness of the crossbar to which the mounting bracket is to be attached.

15. The mounting bracket of claim 9 further comprising a diagonal entrance for insertion of the crossbar therethrough, defined between the locking structure and a downward end of the leg by virtue of the leg being positioned vertically above the locking structure, wherein the mounting bracket is constructed of resilient material, the front plate and the leg adapted to flex away from each other to widen the entrance sufficiently to permit the crossbar to enter into the mounting bracket with clearance past the locking structure.

16. A U-shaped mounting bracket for attachment to a retail crossbar having a rectangular cross-section, the mounting bracket comprising:

a front plate adapted to have display apparatus mounted thereto;

a flange attached to the front plate and projecting away therefrom, the flange including a rear portion extending downwardly and disposed generally parallel to the front plate;

inner surfaces of the front plate and the flange defining an interior space sized to closely receive the crossbar; and a lower end of the front plate being angled to project laterally from the front plate, the lower end of the front plate and a lower end of the rear portion of the flange defining an entrance to the interior space that is sized and oriented, in the entrance's natural state, to prevent the crossbar from entering the interior space, the entrance enlarging to allow the crossbar to pass therethrough and be received within the interior space.

17. A mounting bracket as in claim 15, wherein at least one of the front plate and flange is of resilient material and flexes to widen the entrance sufficient to permit the crossbar to pass therethrough and be received within the interior space.

18.A mounting bracket as in claim 15, wherein the rear portion of the flange projects downwardly a distance at least one half the height of the crossbar to which the mounting bracket is to be attached.

19.A mounting bracket as in claim 15, wherein the front plate, excluding the angled lower end of the front plate, has a height greater than or equal to the height of the crossbar to which the mounting bracket is to be attached.

20. A mounting bracket as in claim 15, wherein the angled lower end of the front plate projects laterally from the front plate a distance at least half the thickness of a crossbar.

21. A mounting bracket as in claim 16, wherein the angled lower end of the front plate does not engage a crossbar when the mounting bracket is attached to and resting on the crossbar, and wherein upward movement of the mounting bracket relative to the crossbar causes the angled lower end of the front plate to engage a front lower corner of the crossbar.

* * * * *